United States Patent [19]

Peterson

[11] 4,393,949

[45] Jul. 19, 1983

[54] ROCK BORING APPARATUS

[75] Inventor: Carl R. Peterson, Boxford, Mass.

[73] Assignee: Peterson Associates, Ltd., Boxford, Mass.

[21] Appl. No.: 220,906

[22] Filed: Dec. 29, 1980

[51] Int. Cl.[3] ..... E21B 10/16

[52] U.S. Cl. ..... 175/377; 175/374; 175/376

[58] Field of Search ..... 175/377, 374, 53, 361-364, 175/376; 299/87

[56] References Cited

U.S. PATENT DOCUMENTS

| | | | |
|---|---|---|---|
| 667,513 | 2/1901 | Forsyth et al. | 175/377 X |
| 2,228,286 | 1/1941 | Ross | 175/377 X |
| 2,399,372 | 4/1946 | Metzger et al. | 175/377 X |
| 2,687,875 | 8/1954 | Morlan et al. | 175/377 X |
| 3,430,718 | 3/1969 | Lawrence | 175/354 X |
| 3,659,660 | 5/1972 | Conn | 175/53 |
| 4,071,098 | 1/1978 | Dively et al. | 175/263 X |

OTHER PUBLICATIONS

Kennemetal Inc. advertisement in *Mining Equipment International*, Oct., 1978, vol. 3, No. 8, p. 5.

*Primary Examiner*—Stephen J. Novosad
*Assistant Examiner*—Thuy M. Bui

[57] ABSTRACT

Apparatus for boring holes in rock comprising a boring head rotatable about an axis of advance and a multiplicity of cutters mounted on the head, a plurality of which each comprises a cutter body rotatable about a cutter axis and cutting tooth means forming a helical path about the cutter axis.

11 Claims, 9 Drawing Figures

ROCK BORING APPARATUS

BACKGROUND OF THE INVENTION

This invention relates to machines for boring holes in rock.

Tunnel boring and other rock boring machines use a variety of rolling cutter devices to attack the rock. Roller cutter drill bits, as commonly used to drill oil-wells, typically use three freely rotating cutters that constitute essentially the entire face of the bit. These cutters are usually covered with protrusions or teeth, often tungsten carbide inserts, that, under great axial force on the bit, simply indent the rock surface, causing excavation by the formation and removal of small local chips from the surface.

Larger hole borers, such as tunnel borers and raise borers, use similar freely rotating cutters that attack the rock face in an identical manner. However, because of the larger hole size, individual roller cutters that are typically small relative to the hole diameter are distributed over the surface of a strong steel cutterhead in a pattern selected to properly cover the rock surface. The entire cutterhead is rotated and driven forward with a large force to advance the bore into the rock. Each individual roller cutter then follows a circular (slightly helical with advance) path about the axis of rotation of the cutterhead (the axis of the hole in a straight hole) while freely rolling along the rock surface. Typically each roller cutter is carried via roller bearings on a fixed axle or shaft, with the latter mounted in a saddle bracket attached to the surface or frame of the cutterhead.

Disc cutters, each consisting in simplest form of a planar sharp-edged disc rotatably mounted on a shaft (like a common glass cutter), are often used in place of toothed cutters on large hole boring machines. An individual rolling cutter body may carry a single disc or cutting edge, or multiple discs spaced a selected distance apart. The cutting edge of the disc may be hardened steel, it may be reinforced with tungsten carbide inserts, or it may simply consist of a row of tungsten carbide inserts closely spaced in the circumferential direction.

Each disc cutter carried on a rotating cutterhead produces a simple circular track or groove in the rock face of the bore. The distance between adjacent tracks or grooves is set by the fixed distance between discs on a single multiple-disc cutter and/or by the fixed radial position of each cutter relative to other cutters on the rotating cutterhead. This distance is selected to assure proper breaking action of the rock.

There is shown in FIG. 1 a diagrammatic side view of a tunnel boring cutterhead equipped with disc cutters. The cutterhead 10 consists of a generally plane central area 12 surrounded by a curved annular region 14 near the periphery, or "gage", of the bore. The gage region provides a curved transition between the plane bore face and the cylindrical bore walls, minimizing the high rock strength problems encountered in attempting to cut a sharp corner, and allowing mounting of gage cutters in the strong and popular saddle brackets (the outer saddle arm would be impossible in or near a square corner between the plane bore face and the cylindrical bore walls).

Disc cutters, when used properly, are very effective in comparison to toothed cutters because they achieve excavation through production of large fragments, with a relatively small fraction of the volume excavated by direct crushing under the rolling edge of the disc. This reduces the forces and energy associated with chip formation and minimizes cutter wear relative to volume excavated.

There is shown in FIG. 2 an illustration of the proper disc cutter action exhibited on the plane portion of the cutterhead. FIG. 2 illustrates this action in terms of the successive positions 16 and 18, before and after one cutterhead revolution, of a pair of discs traveling in adjacent tracks. It can be seen that each disc travels repeatedly in its own track, penetrating the rock, by an amount equal to and parallel to the cutterhead advance per revolution, in a direction also parallel to the plane of the disc. The plane of the disc remains tangent to the cylindrical surface which is the locus of the advancing groove, with the disc rolling along the groove while advancing straight into it with each revolution of the cutterhead.

Each disc advances into the rock with each rotation of the cutterhead largely by crushing the material directly in its path. Adjacent paths or grooves are spaced apart a distance dependent upon rock characteristics (e.g., hardness) such that large chips are periodically broken out between paths. If paths are too close, chips are smaller than they need be and excessive energy is consumed in directly crushing material. If paths are too distant, deep penetration requiring excessive force (or causing interference with non-rolling portions of the cutting assembly) is required before a chip is broken out.

Improper disc cutter action is exhibited whenever a planar disc is used to excavate a rock surface that is not normal to the axis of rotation of the cutterhead. This occurs when disc cutters are used in the "rounded" corner or gage region of a flat-faced boring head, and over most of the surface of a dome-shaped boring head. In this case, if the disc is kept normal to the local rock surface, as it usually is, the plane of the disc is not parallel to the direction of advance.

FIG. 3 illustrates two adjacent tracks on a representative portion of a rock surface that is not normal to the axis of cutterhead rotation or direction of advance. It can be seen that successive passes of each disc with rotation and advance of the cutterhead do not result in deepening of the existing groove in a direction normal to the local mean rock surface. Instead, each disc moves to a position which, from the local rock point of view, appears to be slighly to the side of, and slightly deeper than, the preceding path. This geometry has two undesirable side effects: by effectively moving sideways relative to the rock with each successive pass the disc does not penetrate into its previous path and is forced to directly crush a very large fraction of the rock, and, by penetrating against the relatively blunt flank of the disc, excessive forces in a direction not normal to the cutter axis are required, with consequent danger of cutter bearing overload. In practice, to avoid damaging forces on tunnel borer gage cutters, a large number of discs is used at close spacing near the gage, as shown in FIG. 1, so that a very large portion of excavation occurs as direct crushing with consequent loss of the advantage of disc cutters and also high cutter consumption.

SUMMARY OF THE INVENTION

The helical disc cutter-equipped boring head of my invention provides for straight penetration of each cutter into a groove normal to the local rock surface with successive passes of the cutter regardless of the inclination of the rock surface relative to the axis of rotation and direction of advance of the boring head. The boring head, which is rotatable about an axis of advance, has mounted on it a multiplicity of cutters, at least some of which are helical disc cutters, each comprising a cutter body rotatable about a cutter axis, and cutting tooth means forming a helical path about that axis. Each of those cutter bodies is mounted on the boring head for free rotation about the cutter axis. As a result of this arrangement, the helical path of the cutting tooth means does not close upon itself, but the locus of this path, defined by rotation of the boring head, has a generally conical envelope tapering in the direction of the advance of the boring head.

In one preferred embodiment, the cutting tooth means forms between one and two complete helical turns about a typically cylindrical cutter body. Slightly more than one turn prevents a discontinuity in rolling contact should the ends of the helical tooth wear down. This arrangement (i.e., essentially one helical turn) also maximizes the effective groove-to-groove spacing (essentially the "pitch" of the spiral thread) for a given cutter length.

In another preferred embodiment, the cutting tooth means comprises a single, continuous, wedge-shaped protrusion extending out from the cutter body.

DESCRIPTION OF PREFERRED EMBODIMENTS

We turn now to the description of the preferred embodiments, after briefly describing the drawings.

DRAWINGS

STRUCTURE

Figure 1:
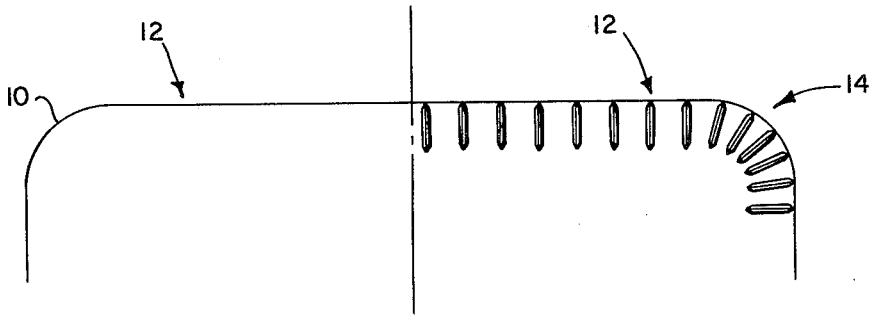
FIG. 1 is a diagrammatic elevation of a flat-faced boring head bearing conventional disc cutters on plane and gage areas.
Figure 2:
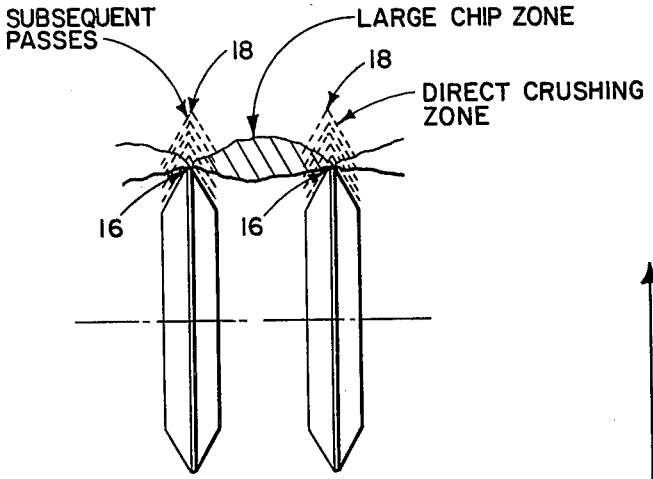
FIG. 2 is a diagrammatic representation of the cutting action of adjacent conventional disc cutters on the plane portion of a flat-faced boring head.
Figure 3:
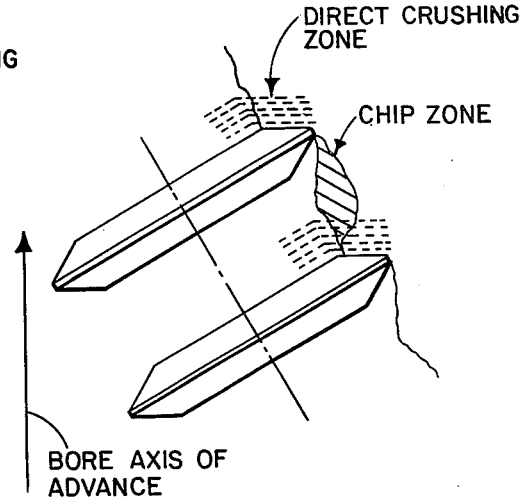
FIG. 3 is a diagrammatic representation of the cutting action of adjacent conventional disc cutters on the gage area of a flat-faced boring head.
Figure 4:
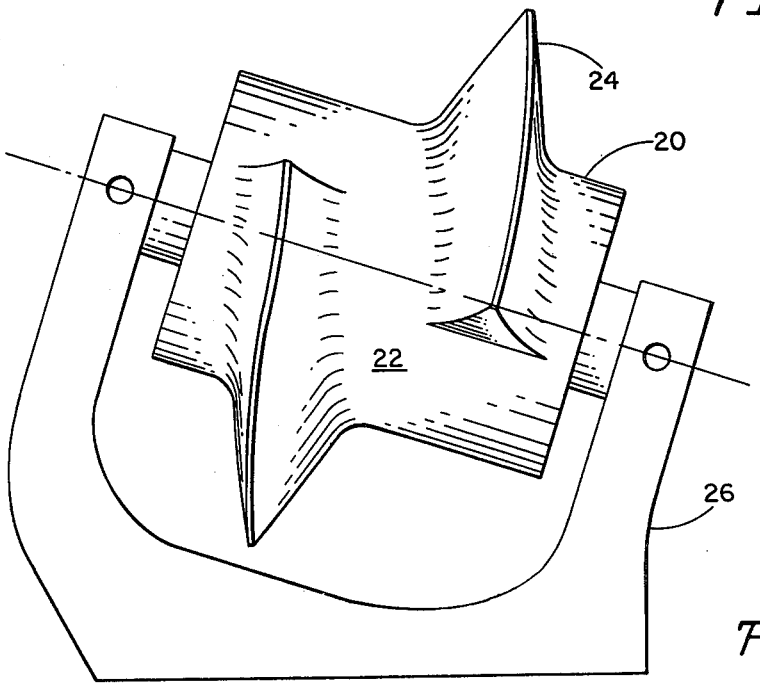
FIG. 4 is a diagrammatic elevation of a portion of a preferred helical disc cutter.

There is shown in FIG. 4 a helical disc cutter 20 mounted in saddle mount 26. The cutter comprises a cylindrical cutter body 22 about which a wedge-shaped cutting tooth 24 makes slightly more than one generally helical turn. The tooth is of hardened or tungsten carbide insert-reinforced steel.

Figure 5:
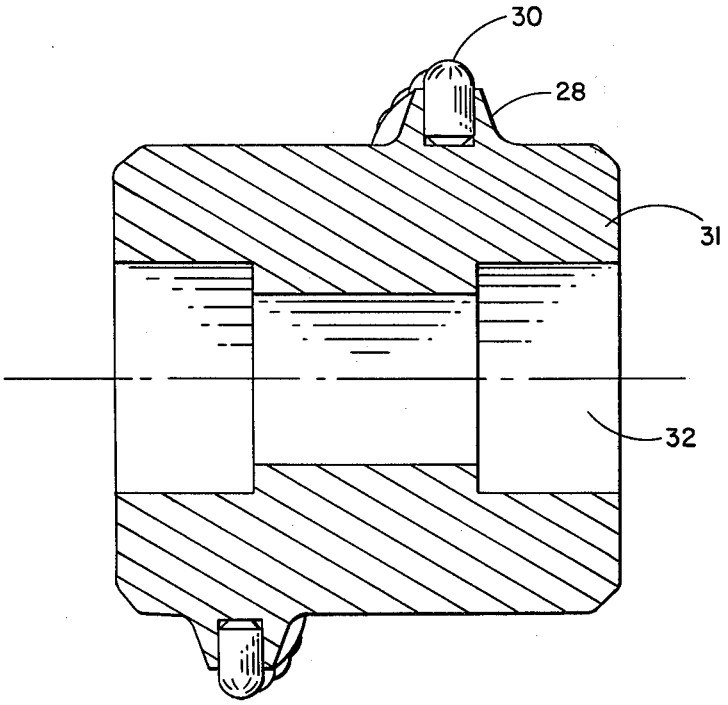
FIG. 5 is a diagrammatic elevation, partly broken away, of a preferred cutter having cutting tooth studs.

There is shown in FIG. 5 another preferred embodiment in which helical cutting tooth 28 includes a row of tungsten carbide studs 30 protruding from the cutting surface. The cutter body 31 is partly broken away to show bearing cavity 32.

Figure 9:
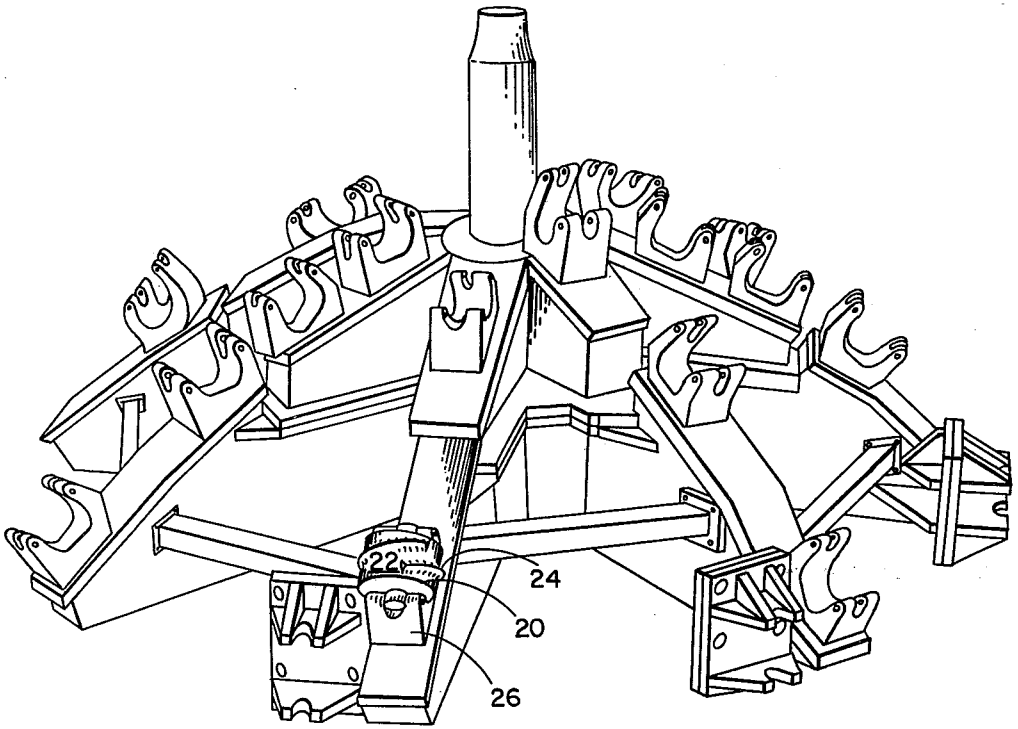
FIG. 9 is a perspective view of a typical dome-shaped boring head.

FIG. 9 shows a preferred dome-shaped rock boring head 34 equipped with a multiplicity of helical disc cutters 20 mounted in saddle mounts 26, as shown in FIG. 4. Because no tangent to any point on the surface of the dome-shaped boring head 34 is normal to head's axis of rotation, the entire head is equipped with helical disc cutters.

OPERATION

Figure 6:
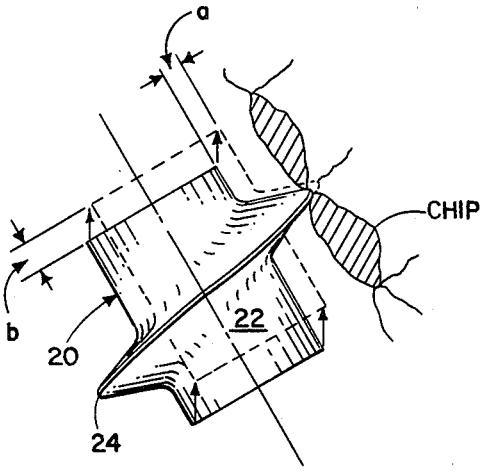
FIG. 6 is a diagrammatic representation of the cutting action of a helical disc cutter mounted on the gage area of a boring head.

FIG. 6 illustrates the action of a preferred helical disc cutter on a portion of a rock face that is not normal to the axis of rotation of the boring head. The cutter is mounted with its axis of rotation essentially parallel with the local rock surface.

After one revolution of the boring head the gross displacement of the cutter, shown exaggerated for clarity in FIG. 6, will be equal to (and parallel to) the advance per revolution of the boring head. This displacement may be broken into a component normal to the local rock surface (penetration displacement), distance a in FIG. 6, and a component parallel to the local rock surface (lateral displacement), distance b in FIG. 6. Rotation of the helical disc cutter about its own axis causes the rolling contact point of the helidisc cutter to shift laterally, parallel to the cutter axis and local rock surface. Rotation of the helical disc cutter by the proper amount then causes the helical tooth to fall directly into the previously formed groove, with the net effect that tooth penetration with each rotation of the boring head is straight into the local rock, or normal to the local rock surface.

Figure 7:
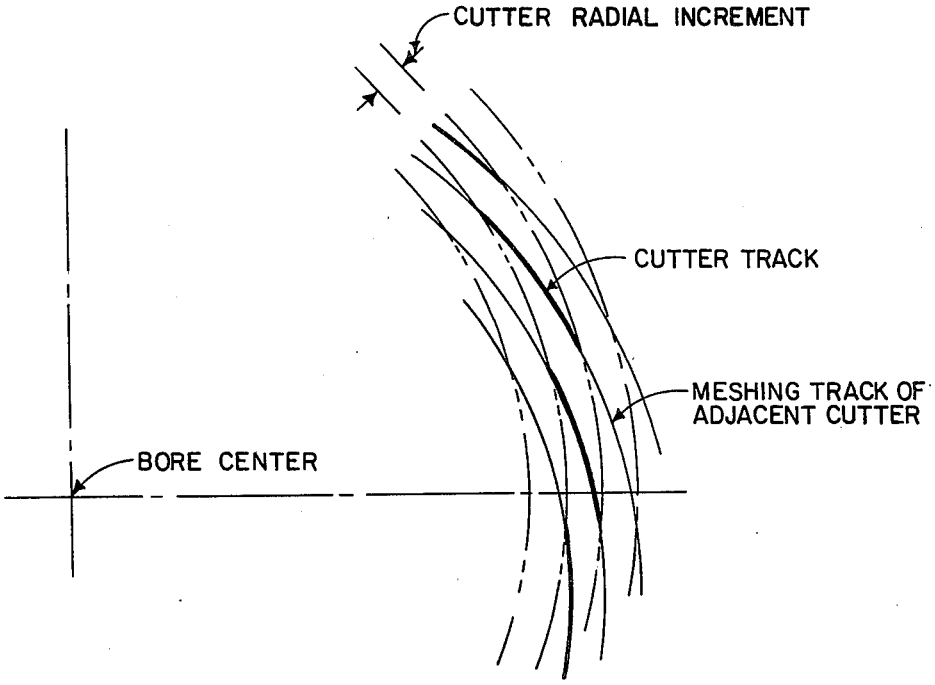
FIG. 7 is a diagrammatic plan view of a rock face showing adjacent cutter tracks in the gage area.

The resultant indentation pattern left in the rock by a helical disc cutter is a series of slightly diagonal grooves as shown in FIG. 7. The spacing between grooves, normal to the groove direction, is essentially the pitch of the helical tooth. The desired self-tracking feature in this pattern is best achieved when the helical disc cutter rotates an integer number of times per revolution of the boring head; this can be accomplished by constructing the boring head and the helical disc cutters mounted on the head such that the diameter of the full helical disc track (i.e., twice the mean radius at which the helical disc cutter rolls on the rock surface) is an integer multiple of the helical disc rolling surface diameter. Ideally, then, each helical disc cutter on a given boring head is of a diameter selected for its mounting position. In practice, however, slight slippage of the cutter permits reasonable departures from this ideal geometry (just as a knurling tool of fixed diameter will function on cylinders of any diameter).

Each helical disc cutter covers a fixed lateral dimension as it rolls on the rock face. Preferably, helical disc covering adjacent lateral intervals are mounted so that these intervals overlap slightly. The overlapped grooves thus produce what amounts to a pattern, shown in FIG. 7, of continuous spiral grooves, further tending to "lock in" the desired self-tracking mode of operation. Furthermore, the overlap zone is always covered by the ends of adjacent helical teeth, giving double coverage and reduced wear at a position on the teeth which might otherwise suffer accelerated wear. For adjacent cutters whose tracks overlap, self-tracking is enhanced if the cutting teeth of those cutters are inclined in the same direction with respect to their direction of rotation, that is, if all such adjacent cutters have left-handed or all have right-handed cutting teeth.

A boring head may, as is shown in FIG. 9, bear two or more cutters having the same track diameters. For all cutters having the same track diameter it is also advantageous that their cutting teeth be inclined in the same direction with respect to their direction of rotation.

Figure 8:
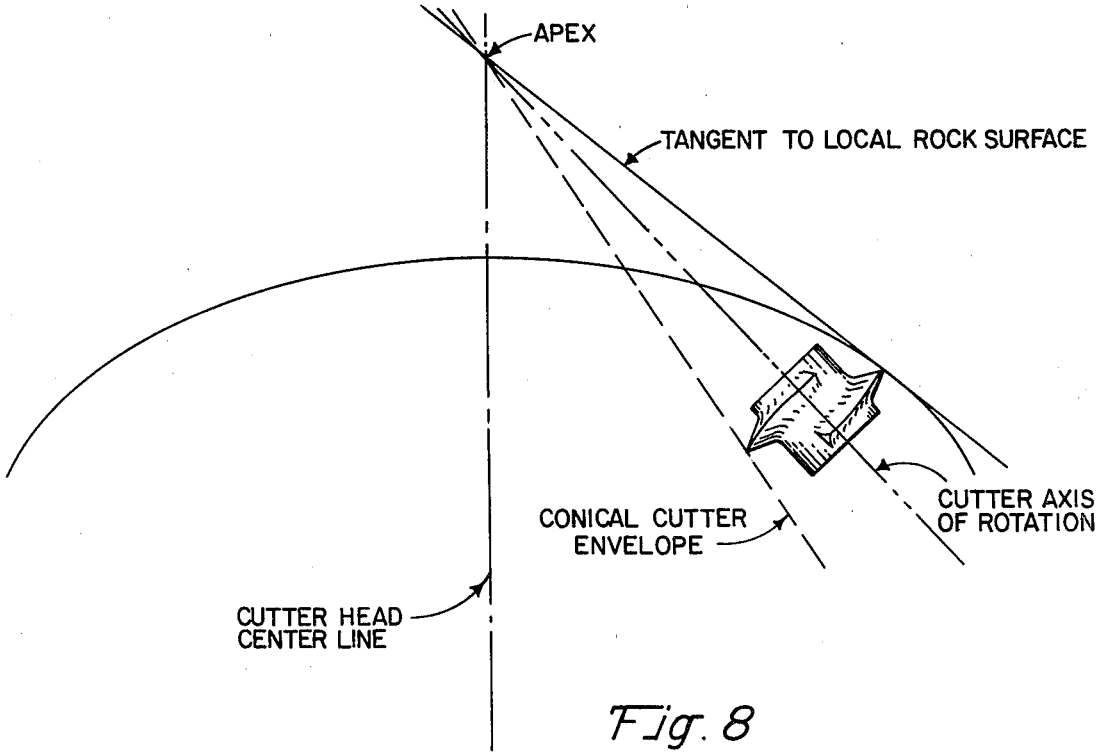
FIG. 8 is a diagrammatic representation of the relationship between the angle of taper of a frustum embodiment of a helical disc cutter and the track diameter of said embodiment.

Since each helical disc cutter also covers a radial increment of the bore hole, pure rolling demands a conical shape wherein the locus of the helical tooth diameter is actually a portion of a cone whose apex coincides with the apex of a cone defined by the local (mean) rock surface, as illustrated in FIG. 8. For single turn teeth and generally for small radial increments relative to the mounted radius, this is not an important refinement, but for more than single turn geometries, as shown in FIG. 8, an overall conical element and a generally conical (rather than cylindrical) body is quite advantageous.

OTHER EMBODIMENTS

Other embodiments are within the following claims. For example, each helical disc cutter may include several helical turns of cutting tooth means. Multiple turns are advantageous where smaller spacing between cutters or smaller pitch is desired. Such is the case, for example, when exceptionally hard rock is being cut.

I claim:

1. Apparatus for boring holes in rock comprising
a boring head rotatable about an axis of advance, and
a multiplicity of cutters mounted on said head, at least
a plurality of said cutters each comprising a helical disc cutter comprising
a cutter body rotatable about a cutter axis, and
cutting tooth means forming a helical path about said cutter axis, wherein said path does not close upon itself, the locus of said path upon rotation of said head having a generally conical envelope tapering in the direction of said advance
each said cutter body being mounted on said boring head for free rotation about said cutter axis, whereby each cutting tooth means cuts a substantially circular track about said axis of advance.

2. The apparatus of claim 1 wherein said cutting tooth means forms at least one helical turn about said cutter axis.

3. The apparatus of claim 1 wherein said cutting tooth means comprises a single, continuous, wedge-shaped protrusion.

4. The apparatus of claim 1 wherein said cutting tooth means includes a plurality of studs protruding from its cutting surface.

5. The apparatus of claim 1 wherein said boring head includes a region whereon said cutters are mounted such that their axes of rotation are not normal to said axis of advance of said boring head, said cutters mounted on said region comprising helical disc cutters.

6. The apparatus of claim 1 wherein at least some of said helidisc cutters are mounted on said boring head such that their tracks are of the same diameter, the helical paths of said cutting tooth means of all said cutters having the same said track diameters being inclined in the same direction with respect to their direction of rotation.

7. The apparatus of claim 1 wherein each said helical disc cutter is mounted on said boring head such that said cutter rotates an integer number of times per revolution of said boring head.

8. The apparatus of claim 7 wherein the track diameter of each said helical disc cutter is an integer multiple of the diameter of the cross section of said helical disc cutter.

9. The apparatus of claim 1 wherein at least some of said helidisc cutters are mounted on said boring head such that their tracks overlap.

10. The apparatus of claim 9 wherein said helical paths of said cutting tooth means of all said cutters having overlapping tracks are inclined in the same direction with respect to their direction of rotation.

11. A cutter useful in apparatus for boring holes in rock comprising a boring head rotatable about an axis of advance, said cutter comprising
a cutter body rotatable about a cutter axis, and
cutting tooth means forming at least one helical turn about said cutter axis, wherein said turn does not close upon itself, the locus of said path upon rotation of said head having a generally conical envelope tapering in the direction of said advance
each said cutter being adapted to be mounted on said boring head for free rotation about said cutter axis, whereby each said cutting tooth means cuts a substantially circular track about said axis of advance.

* * * * *